US006711862B1

(12) United States Patent
Long

(10) Patent No.: US 6,711,862 B1
(45) Date of Patent: Mar. 30, 2004

(54) DRY-CAST HOLLOWCORE CONCRETE SANDWICH PANELS

(75) Inventor: Robert T. Long, Ames, IA (US)

(73) Assignee: Composite Technologies, Corporation, Boone, IA (US)

( * ) Notice: Subject to any disclaimer, the term of this patent is extended or adjusted under 35 U.S.C. 154(b) by 58 days.

(21) Appl. No.: 09/876,293

(22) Filed: Jun. 7, 2001

(51) Int. Cl.[7] ..... E04B 2/84

(52) U.S. Cl. ..... 52/309.1; 52/309.11; 52/309.12; 52/309.17

(58) Field of Search ..... 52/309.1, 309.11, 52/309.12, 309.17, 309.2, 309.5, 309.6

(56) References Cited

U.S. PATENT DOCUMENTS

| | | | | | |
|---|---|---|---|---|---|
| 1,958,049 | A | | 5/1934 | Kleitz | |
| 2,412,744 | A | | 12/1946 | Nelson | |
| 2,645,929 | A | | 7/1953 | Jones | |
| 2,653,469 | A | | 9/1953 | Callan | |
| 2,775,018 | A | | 12/1956 | McLaughlin | |
| 3,274,680 | A | | 9/1966 | Cruse | |
| 3,295,278 | A | * | 1/1967 | Muhm | 52/223.6 |
| 3,426,494 | A | | 2/1969 | Hala | |
| 3,466,825 | A | * | 9/1969 | Guddal | 52/344 |
| 3,750,355 | A | | 8/1973 | Blum | |
| 3,922,413 | A | * | 11/1975 | Reineman | 428/119 |
| 3,927,857 | A | | 12/1975 | Lovisa et al. | |
| 3,965,635 | A | | 6/1976 | Renkert | |
| 4,052,831 | A | | 10/1977 | Roberts et al. | |
| 4,056,910 | A | * | 11/1977 | Hiatt et al. | 52/600 |
| 4,109,436 | A | | 8/1978 | Berloty | |
| 4,283,896 | A | | 8/1981 | Fricker et al. | |
| 4,329,821 | A | * | 5/1982 | Long et al. | 52/309.12 |
| 4,348,847 | A | | 9/1982 | Jukes | |
| 4,348,848 | A | | 9/1982 | Denzer | |
| 4,393,635 | A | | 7/1983 | Long | |
| 4,489,530 | A | | 12/1984 | Chang | |
| 4,545,163 | A | | 10/1985 | Asselin | |
| 4,624,089 | A | | 11/1986 | Dunker | |
| 4,628,653 | A | * | 12/1986 | Nash | 52/309.12 |
| 4,632,796 | A | | 12/1986 | Moulet | |
| 4,669,240 | A | | 6/1987 | Amormino | |
| 4,702,053 | A | | 10/1987 | Hibbard | |
| 4,805,366 | A | * | 2/1989 | Long | 52/309.11 |
| 4,829,733 | A | * | 5/1989 | Long | 52/309.11 |
| 4,974,381 | A | | 12/1990 | Marks | |
| 5,519,973 | A | | 5/1996 | Keith et al. | |
| 5,588,272 | A | | 12/1996 | Haponski | |
| 5,596,853 | A | | 1/1997 | Blaney et al. | |
| 5,671,574 | A | | 9/1997 | Long | |
| 5,673,525 | A | * | 10/1997 | Keith et al. | 52/309.11 |
| 5,927,032 | A | * | 7/1999 | Record | 52/309.11 |
| 6,116,836 | A | * | 9/2000 | Long, Sr. | 411/451.1 |

FOREIGN PATENT DOCUMENTS

| | | |
|---|---|---|
| DE | GE 1 683 498 | 9/1967 |
| FR | 2 360 723 | 7/1977 |
| FR | 2 670 523 | 12/1990 |

* cited by examiner

*Primary Examiner*—Carl D. Friedman
*Assistant Examiner*—Basil Katcheves
(74) *Attorney, Agent, or Firm*—Kent Herink; Daniel Rosenberg; Davis Law Firm

(57) ABSTRACT

A concrete sandwich panel is provided with a first dry-cast hollowcore concrete layer having pre-stressing strands, and a second concrete layer, and an insulation layer sandwiched therebetween. The insulation layer includes pre-formed holes. A tool is used to form holes in the first concrete layer aligned with the insulation holes. Adhesive is injected into the concrete holes, with connectors extending through the insulation layer and into the concrete holes. The adhesive, when cured, locks the connector in the hollowcore concrete layer. The upper concrete layer is cast over the insulation layer so as to embed the upper ends of the connectors. The plasticity of the upper concrete layer, which may result from vibration energy input to low-slump concrete, allows the concrete to consolidate around the upper ends of the connectors. When the concrete layers cure, the connectors tie the layers together to preclude excessive shear displacement between the concrete.

10 Claims, 4 Drawing Sheets

DRY-CAST HOLLOWCORE CONCRETE SANDWICH PANELS

BACKGROUND OF THE INVENTION

Concrete sandwich panels are well known in the art, and generally comprise spaced apart layers of concrete with an insulation layer sandwiched between the concrete layers. Connectors extend through the insulation layer and into the concrete layers to tie the concrete layers together when the concrete cures.

Concrete sandwich panel connectors normally are supplied with deformations or anchorage zones to provide notches, bosses, or other irregularities in the connector. Such connectors are usually installed in highly plastic concrete, which can flow into or around the deformations in the connectors, such that, upon hardening of the concrete, the connector and concrete are locked together. The consolidation of the concrete flowing into and around the irregularities in the anchorage zones of the connectors creates a mechanical interlock between the connector and the concrete.

In contrast, when sandwich panel connectors are installed in stiff or dry concrete, such as dry-cast concrete, the concrete is not capable of flowing into and around the irregular surfaces on the anchorage zones. Rather, the connectors create a hole in the concrete that remains after installation of the connectors. The connectors therefore are not anchored to the concrete, and can be easily pulled out with little or no load.

Extrusion is a common method used to produce lightweight, economical pre-cast concrete floor and wall panels. The extruded concrete normally includes longitudinal voids, or cores, such that the panels are commonly called "hollow-core panels." Machines are used to slip form concrete with zero or low-slump into such hollowcore panels. Zero or low-slump material generally is defined as material having 0–1 inch of slump using standardized ASPM slump testing. This concrete, while including water or moisture, is very dry, and therefore will not flow around the sandwich panel anchorage zones. This concrete is commonly called "dry-cast."

For this type of hollowcore panels, it is common to form sandwich panels using steel or stainless steel clips that must be anchored by hooking one end of the clips around a steel pre-stressing strand which is placed in the hollowcore layer during slip forming. In order to access the strand, the cured hollowcore concrete is excavated, and the connectors hooked around the exposed strand. The resulting hole in the hollowcore panel is then patched around the installed connector. This work is highly labor intensive and fails to provide a reliable anchorage of the connector in the concrete. The hooks of such steel clips can be straightened with a relatively small force, compared to the tensile capacity of the wire itself. Therefore, the pullout capacity of such anchorage clips is small. Also, the repair to the excavated concrete may leave voids around the wire clips. Since the wire clips are not embedded in the concrete, the clips are free to slide down the steel reinforcing strands in the hollowcore panel. This creates serious problems during handling and installation of the sandwich panels, with the face layer shifting more than an inch as the panel is moved to a vertical position. Furthermore, the excavation process can lead to zones within the panel wherein the reinforcing steel is not encased in the concrete. Because concrete creates a protective environment that slows the corrosion process for embedded steel, and because condensation is a common occurrence in sandwich panels, there is a serious probability that the reinforcing steel within the hollowcore panels will corrode and fail as a result of the installation of the hooked sandwich panel connectors or clips.

The installation of anchors or connectors in cured concrete using two-part epoxy adhesives is known in the art. This installation process requires that holes be drilled into the hardened concrete, which is highly labor intensive and time consuming.

Accordingly, a primary objective of the present invention is the provision of an improved dry-cast concrete hollowcore sandwich panel.

A further provision of the present invention is the provision of an improved hollowcore sandwich panel having connectors consolidated in the concrete layers.

A further objective of the present invention is the provision of a connection system that can be installed in dry or low-slump concrete.

Another objective of the present invention is the provision of a process for installing connectors in hollowcore sandwich panels.

A further objective of the present invention is the provision of a connection system, and a process for installing the connection system, that is positively anchored in the concrete layers of a sandwich panel, and does not allow large shear displacement of one layer of concrete relative to the other.

Another objective of the present invention is a concrete sandwich panel, and a method of producing the panel, without voids around the reinforcing steel strands contained in the panel.

A further objective of the present invention is the provision of hollowcore sandwich panels having a connection system with low thermal conductivity.

Still another objective of the present invention is the provision of hollowcore sandwich panels that the insulation system provides a uniform, verifiable spacing for the connectors.

Another objective of the present invention is the provision of a hollowcore sandwich panel having an improved concrete connection system.

A further objective of the present invention is the provision of a method for installing a connection system into a hollowcore sandwich panel utilizing minimum labor costs.

Another objective of the present invention is the provision of a hollowcore concrete sandwich panel that is economical to manufacture, and durable and efficient in use.

BRIEF SUMMARY OF THE INVENTION

The concrete sandwich panels of the present invention include a first hollowcore concrete layer and a spaced apart second concrete layer. Insulation is sandwiched between the concrete layers. Preferably, the hollowcore layers are constructed by slip forming zero or low-slump material, so as to have a plurality of voids and concrete webs. The hollowcore layer includes pre-stressing strands in some of the webs. The insulation layer includes a plurality of preformed holes. Holes are formed in the hollowcore layer before the concrete hardens and in alignment with the insulation holes. Adhesive, preferably a two-part epoxy or acrylic, is injected or otherwise supplied into the holes in the hollowcore layer. The adhesive provides a strong bond between the connector and the hollowcore layer. Connectors having low thermal conductivity are inserted through the insulation holes and into the holes in the hollowcore layer. A second concrete face layer is formed on top of the insulation, with the opposite ends of the connectors extending into the face layer, which consolidates around an anchoring surface on the upper end of the connectors.

DETAILED DESCRIPTION OF THE INVENTION

Figure 1:
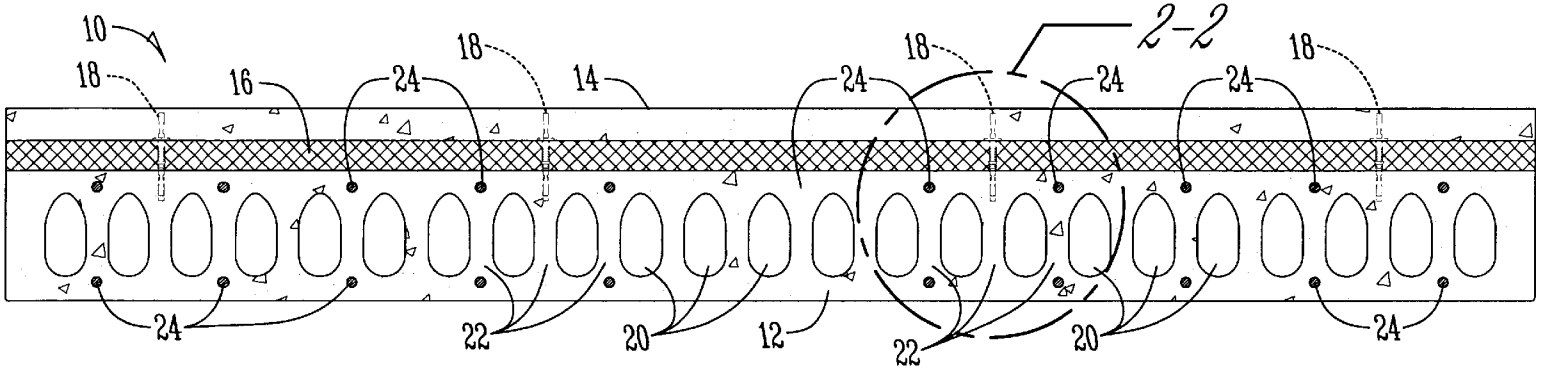
FIG. 1 is an end elevation view of a dry-cast concrete hollowcore panel according to the present invention.

The concrete sandwich panel of the present invention is generally designated in the drawings by the reference numeral 10. The panel includes a first concrete layer 12, a second concrete layer 14, and an insulation layer 16 sandwiched between the concrete layers 12, 14. The plurality of connectors 18 extend through the insulation layer 16 and into the concrete layers 12, 14 to tie the concrete layers together after the concrete has hardened.

Preferably, the first concrete layer 12 is a hollowcore layer extruded by a slip-forming machine. The hollowcore layer 12 has a plurality of voids 20 extending longitudinally, with interconnecting webs 22 of concrete. In the enlarged view of FIG. 2, the webs are identified as 22A, 22B, and 22C. The concrete layer 12 is preferably formed with a low-slump material commonly used in "dry-cast" processes. For purposes of this application, low-slump material includes zero slump material.

Preferably, the first concrete layer 12 is constructed by a slip-form machine using the low-slump material, which is very dry. The voids 20 are formed during the slip-forming extrusion process. A plurality of pre-stressing steel strands 24 are also placed in the first layer 12 during the extrusion process. The strands 24 run longitudinally and are positioned in some of the webs 22, as seen in the drawings.

The insulation layer 16 has pre-formed holes 26. A tool is used to push through the holes 26 and into the dry-cast concrete of the first layer 12 so as to form holes 28 therein. Thus, the holes 28 in the first concrete layer 12 are aligned with the holes 26 in the insulation layer 16.

Figure 2:
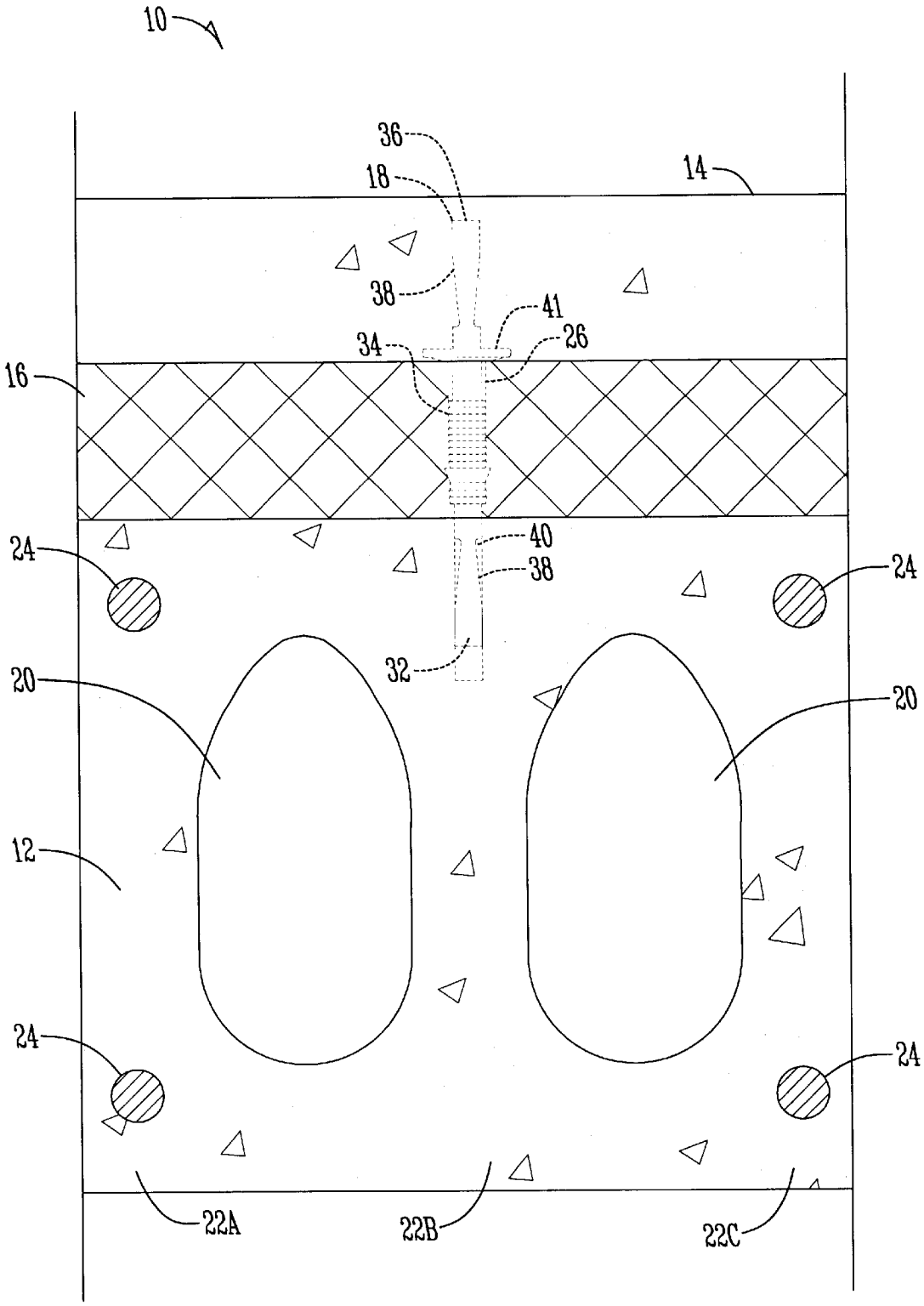
FIG. 2 is an enlarged elevation view taken along lines 2—2 of FIG. 1.

A connector 18 is adapted to extend through each of the holes 26 and into the holes 28, as best seen in the enlarged drawing of FIG. 2. More particularly, the connector 18 has a lower end 32 residing within the hole 28, a central ribbed portion 34 residing within the hole 26 of the insulation layer 16, and an upper end 36. The lower end 32 and upper end 36 of the connector 18 has a tapered profile, or is otherwise irregularly shaped, so as to provide an anchoring surface 38. The lower end 32 of the connector 18 is anchored in the first concrete layer 12 using an adhesive 40 which fills the hole 28. The adhesive 40 may comprise any cementitious or plastic materials that can be injected into the concrete layer 12 or the hole 28, set and harden, bond with wet concrete, and are chemically compatible with concrete. Preferably, the adhesive 40 is a two-part epoxy or acrylic which hardens to lock the connector 18 in the first concrete layer 12. The upper end 36 is embedded in the second concrete layer 14, which is more plastic and therefore consolidates around the anchoring surface 38 of the upper end 36 of the connector 18. The connectors each have an enlarged flange 41 which limits the penetration of the connector 18 by engagement with the upper surface of the insulation layer 16.

Figure 2A:
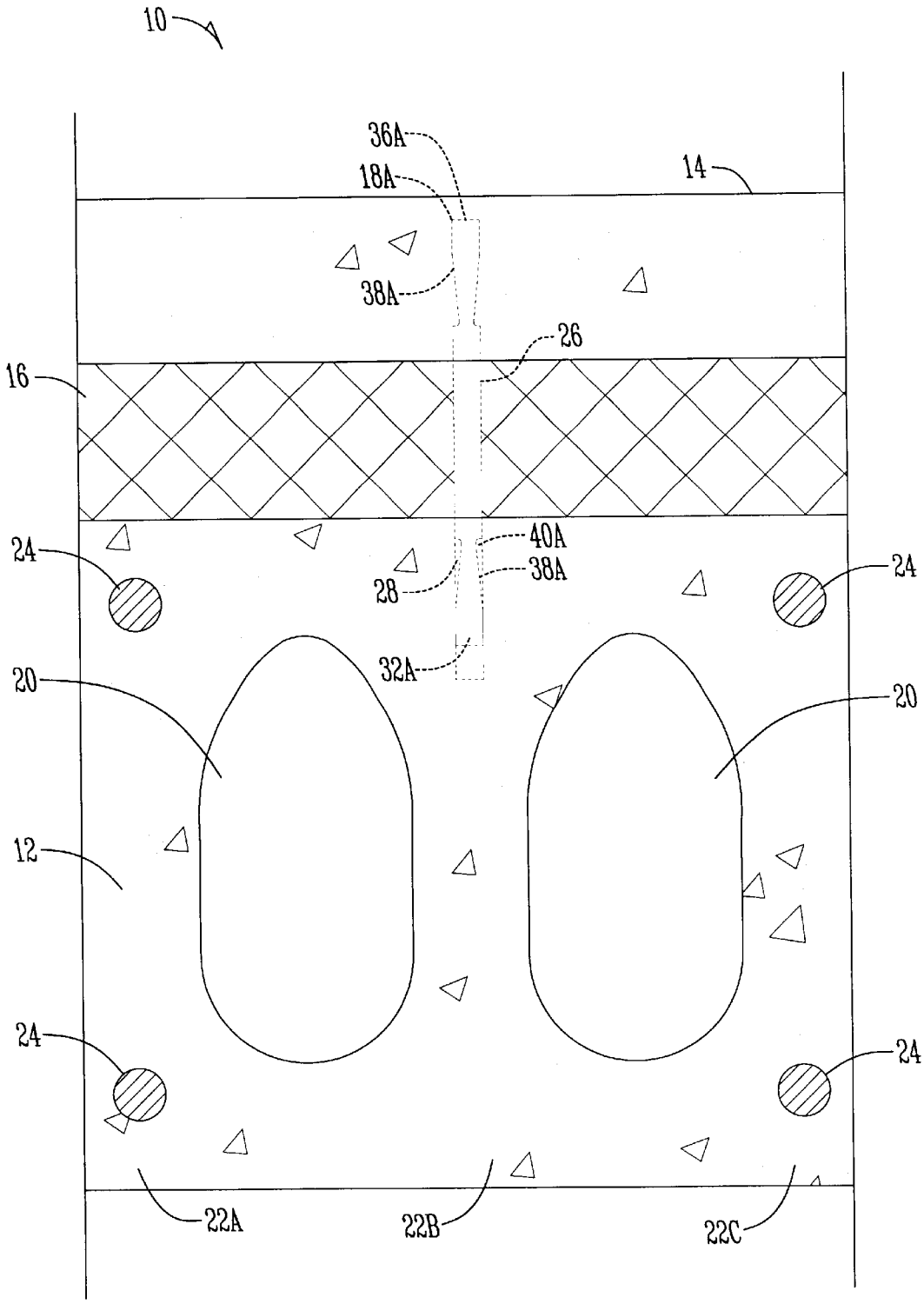
FIG. 2A is a view similar to FIG. 2 showing an alternative embedment of the connector.

As an alternative to the connector shown in FIG. 2, the flange 41 and/or ribs 34 may be eliminated to provide a smooth central portion in a connector 18A, as shown in FIG. 2A. The depth of the embedment of the connector 18A is limited to the depth of the hole 28 in the concrete layer 12. The diameter of the preformed hole 28 can be minimized to reduce the opportunity for misalignment of the connection 18A.

Figure 4:
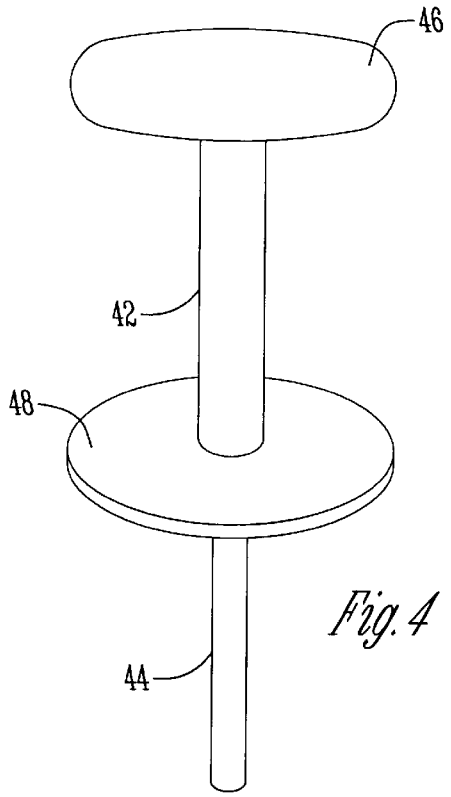
FIG. 4 is a perspective view of one type of tool that can be used to form the connector holes in the dry-cast concrete layer.
Figure 5:
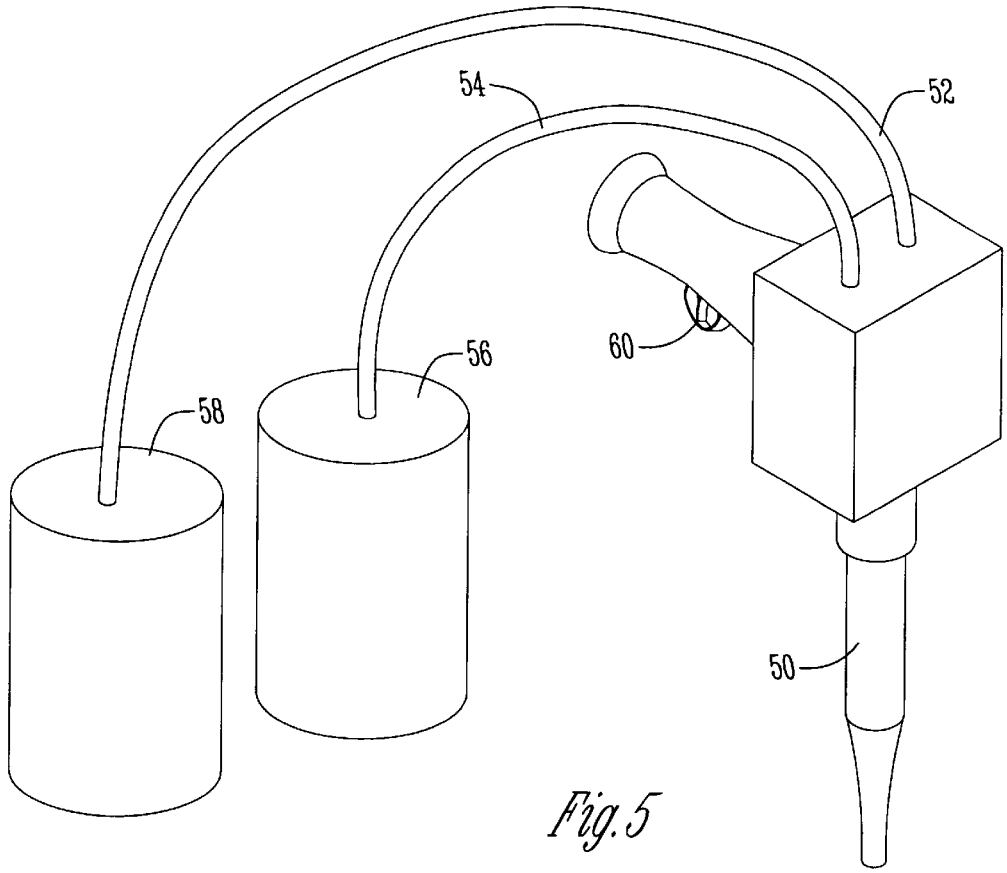
FIG. 5 is a perspective view of another tool that can be used to form the holes in the dry-cast concrete layer and inject adhesive therein.

FIGS. 4 and 5 show two tools for forming the holes 28 in the first concrete layer 12. FIG. 4 shows a simple probe 42 having a lower end 44, a handle 46, and a flange 48 between the lower end 44 and the handle 46. The lower end 44 of the probe 42 is adapted to extend through the hole 26 in the insulation layer 16 and displace a portion of the concrete in the first layer 12. The flange 48 limits the penetration of the probe 42 by engaging the upper surface of the insulation layer 16. After penetration of the probe 42 into the first concrete layer 12, the probe 42 is removed, thereby leaving the hole 28 in the concrete layer 12.

FIG. 5 shows an alternative tool, including a shielded hollow probe 50, which is adapted to displace the concrete in the first layer 12, similar to the probe 42, and automatically apply the adhesive 40 in the hole 28. The probe 50 is connected by conduits 52, 54 to an epoxy container 56 and a catalyst container 58. Flow of epoxy and catalyst from the containers 56, 58 is controlled by a trigger 60. The probe 50 also includes known adjustment means for adjusting the mixture of epoxy and catalyst before it is ejected from the probe 50.

Figure 3:
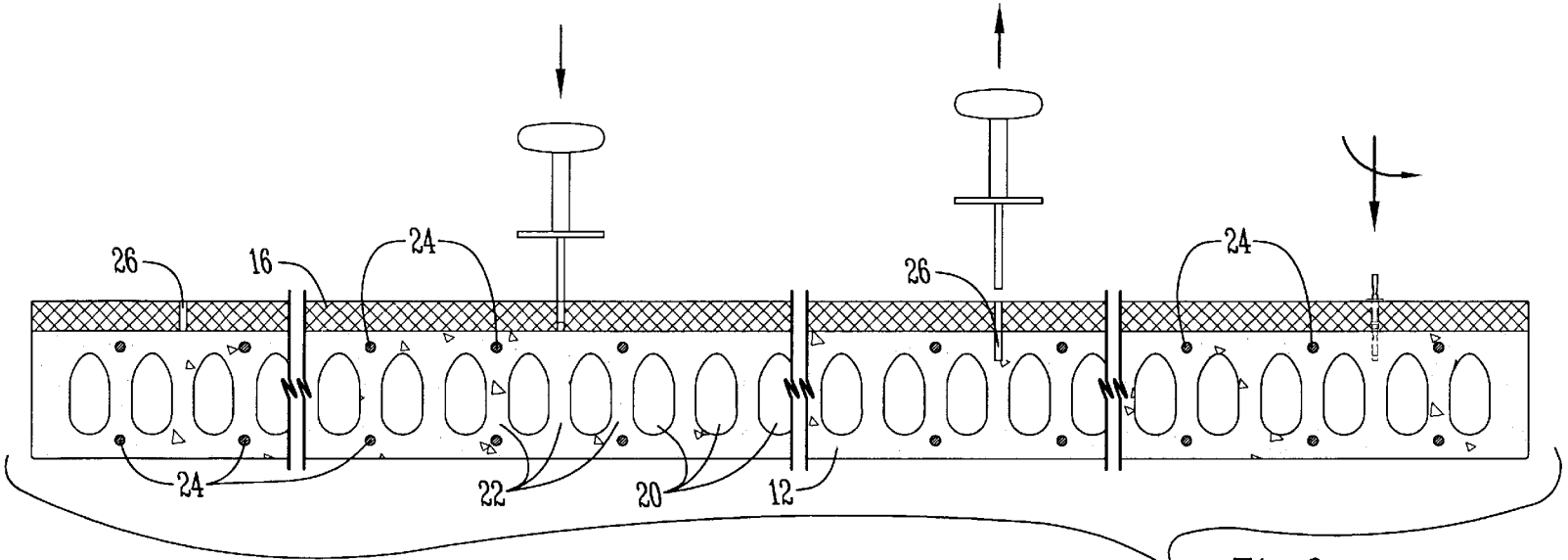
FIG. 3 is a schematic view illustrating the construction process for the panel of the present invention.

In constructing the panel 10 of the present invention, the first concrete layer 12 is extruded by the slip-form machine, with the pre-stressing strands 24 laid in the webs 22 during the extrusion process. The insulation layer 16 with the predrilled holes 26 is then placed on top of the uncured concrete layer 12. One of the probes 42, 50, or any other suitable tool, is then used to form the holes 28 in the first concrete layer 12. Adhesive 40 is supplied into the holes 28, either simultaneously with the formation thereof, or immediately before the connectors 18 are inserted into the holes 26, 28. As seen in FIG. 3, preferably, each connector 18 is forced downwardly through the insulation layer 16 and into the first concrete layer 12, and then turned or twisted approximately 90° (as depicted by the arrows in the right hand portion of FIG. 3) so as to facilitate consolidation of the adhesive around the anchoring surface 38 of the connector 18. The upper or second concrete layer 14 is then poured onto the insulation layer 16, so as to embed the upper ends 36 of the connectors 18 therein. Since the second concrete layer 14 is relatively plastic, or is vibrated to consolidate it around anchorage end 36, the concrete will consolidate around the anchoring surface 38 on the upper ends 36 of the connectors 18. Upon hardening of the concrete layers 12, 14, the connectors 18 will tie the concrete layers together to,form a composite panel having very little shear displacement between the concrete layers 12, 14. Also, the connectors 18 are preferably made of material having a high R-value, so as to have low thermal conductivity.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A concrete sandwich panel, comprising:

a first slip-formed concrete layer comprising low-slump concrete that maintains its shape after it is slip-formed or tooled;

an insulation layer adjacent the first layer;

a second slip-formed layer of concrete adjacent the insulation layer;

a plurality of preformed cavities in the first layer of concrete;

a plurality of connectors extending through the insulation layer and into the cavities of the first layer of concrete and into the second layer of concrete; and a low to medium viscosity bonding material filling the cavities around the connectors to bond the connectors and the first layer of concrete.

2. The concrete sandwich panel of claim 1, wherein the bonding material comprises an adhesive to secure the connector ends in the holes in the first panel.

3. The concrete sandwich panel of claim 2 wherein the adhesive is selected from the group consisting of epoxy, acrylic, cementitious mortar, and Portland cement paste.

4. The concrete sandwich panel of claim 1, further comprising a plurality of prestressing strands in the first concrete panel, and wherein the first concrete panel includes concrete webs, and the prestressing strands and connectors being in separate webs.

5. A concrete sandwich panel, comprising:

a first layer of concrete made of low-slump material;

a second concrete layer;

an insulation layer sandwiched between the concrete layers;

a plurality of holes formed in the first layer, each hole being adapted to receive one end of a connector;

a plurality of connectors having opposite ends extending into the concrete layers; and a bonding material filling the holes around the end of the connector to tie the layers together after the concrete and bonding material hardens.

6. The concrete sandwich panel of claim 5 further comprising a plurality of reinforcing members extending through the first layer and being spaced from the connectors.

7. The concrete sandwich panel of claim 5 wherein the first layer has a hollowcore construction.

8. The concrete sandwich panel of claim 5 wherein the bonding material comprises an adhesive placed into the first layer holes before the connectors are inserted therein.

9. The concrete sandwich panel of claim 5 wherein the depth of the embedment of the connectors into the first concrete layer is limited by the depth of the holes in the first concrete layer.

10. The concrete sandwich panel of claim 5 wherein the connectors each have a flange to limit movement through the insulation layer.

* * * * *